US007229333B2

(12) United States Patent
Bamesberger

(10) Patent No.: US 7,229,333 B2
(45) Date of Patent: Jun. 12, 2007

(54) METHOD AND SYSTEM FOR THE DISTRIBUTION AND MAINTENANCE OF ENTERTAINMENT-RELATED OBJECTS AND DEVICES

(76) Inventor: Gary Bamesberger, 15841 NE. 162nd St., Woodinville, WA (US) 98072

( * ) Notice: Subject to any disclaimer, the term of this patent is extended or adjusted under 35 U.S.C. 154(b) by 207 days.

(21) Appl. No.: 10/809,035

(22) Filed: Mar. 25, 2004

(65) Prior Publication Data

US 2005/0215169 A1 Sep. 29, 2005

(51) Int. Cl.
*A63H 33/04* (2006.01)

(52) U.S. Cl. ..... 446/75; 446/482

(58) Field of Classification Search ..... 446/1, 446/75, 86, 227, 479, 482
See application file for complete search history.

(56) References Cited

U.S. PATENT DOCUMENTS 4,857,028 A * 8/1989 Pail ..... 446/82
5,055,081 A * 10/1991 Nayak ..... 446/75
5,692,943 A * 12/1997 Copp ..... 446/75
5,873,762 A * 2/1999 de Chazal ..... 446/75
6,641,455 B2 * 11/2003 Chan ..... 446/297
6,964,595 B2 * 11/2005 Libretti ..... 446/482

OTHER PUBLICATIONS www.infectioncontrol.ucsmedicalcenter.org; 2 pages, 1996.*
www.metrokc.gov/health/childcare/cleantoys.doc; 2 pages, revised Feb. 13, 2002.*

* cited by examiner

*Primary Examiner*—Kien Nguyen
(74) *Attorney, Agent, or Firm*—Olympic Patent Works PLLC

(57) ABSTRACT

A method for distribution and maintenance of entertainment-related objects and devices. A predetermined operational location is provided with toys and a toy station that serves as a hub for toy deployment for the on-site use of the toys by people at the location. Each toy station contains a means of disinfecting toys prior to use by the toy-user. Each toy is permanently mounted to a substrate that removably attaches to the toy station. Each substrate is readily identifiable as belonging to a given toy station to reduce theft and intermixing of provided toys with any personal toys of any toy-users. Each toy is regularly inspected, documented, cleaned, and checked for functionality and safety. Unsafe, broken, and undocumented toys are removed and replaced with new toys.

2 Claims, 10 Drawing Sheets

METHOD AND SYSTEM FOR THE DISTRIBUTION AND MAINTENANCE OF ENTERTAINMENT-RELATED OBJECTS AND DEVICES

TECHNICAL FIELD

The present invention relates to the field of entertainment services and, more particularly, to a method and system for distribution and maintenance of entertainment-related objects and devices.

BACKGROUND OF THE INVENTION

Children often accompany parents during activities such as making appointments, shopping, running errands and transacting business. Such activities rarely interest children and, as a result, children can become bored, temperamental and irritable. Over time, continual complaining and emotional outbursts may ensue. In turn, parents may become frustrated and stressed, and their attention diverted from the business at hand.

In places where transactions can be lengthy, such as office waiting rooms and car dealerships, businesses have recognized the value of providing toys to engage children, and even adults. By keeping children entertained, the provision of toys and entertainment-related devices may, in turn, provide a more relaxed atmosphere more conducive to effectively carrying out transactions and other business activities. However, many places frequented by children do not provide toys for on-site use. Moreover, many places that do provide toys have neither the time nor the resources to properly maintain the toys and entertainment-related devices. As a result, the toys and other entertainment-related devices may be unsanitary and intermixed with personal toys and artifacts from previous users. Moreover, the entertainment devices may have broken or missing pieces, be non-functional, be subject to recall, and may even be dangerous. Finally, the toys and entertainment devices may be mislaid or inadvertently or intentionally removed. Accordingly, parents, business owners, business employees, and consumers have recognized a need for a method to provide and maintain clean, engaging, safe and functional toys and entertainment-related devices.

SUMMARY OF THE INVENTION

The present invention provides a method for distribution and management of entertainment devices. In one embodiment of the invention, a toy station is provided to a location. The toy station holds one or more toys, each toy permanently mounted to a separate, light-weight, distinct-in-appearance substrate readily identifying the toy as part of a distinguishable set of toys. By distinctly marking the toys, theft and intermixing of toy-station toys with other toys and objects is reduced or prevented. The toy station also contains a disinfectant-wipe dispenser for provision of disinfect. A toy-station user, or the parent of guardian of a toy-station user, may easily disinfect a toy prior to use, disposing the disinfectant-wipe in a used-disinfectant-wipe receptacle for discarding used disinfectant-wipes. In alternate embodiments, other types of disinfectant methods may be employed, including sprays, liquids, and electromagnetic radiation.

Each toy within the toy station, or in the surrounding area, is regularly inventoried, cleaned, inspected, checked against product recall lists, and removed and/or replaced if damaged, recalled, not a toy-station toy, non-operational, or scheduled for rotation or retirement. Each attached substrate may also contain branding information and documentation of the history of the toy, including the date of the last servicing, inspection, cleaning, as well as any applicable toy-use instructions. Toys are rotated into and out from the set of toy-station toys on a regular basis, to maintain interest in the toy-station toys by toy-station users.

DETAILED DESCRIPTION OF THE INVENTION

Figure 1A:
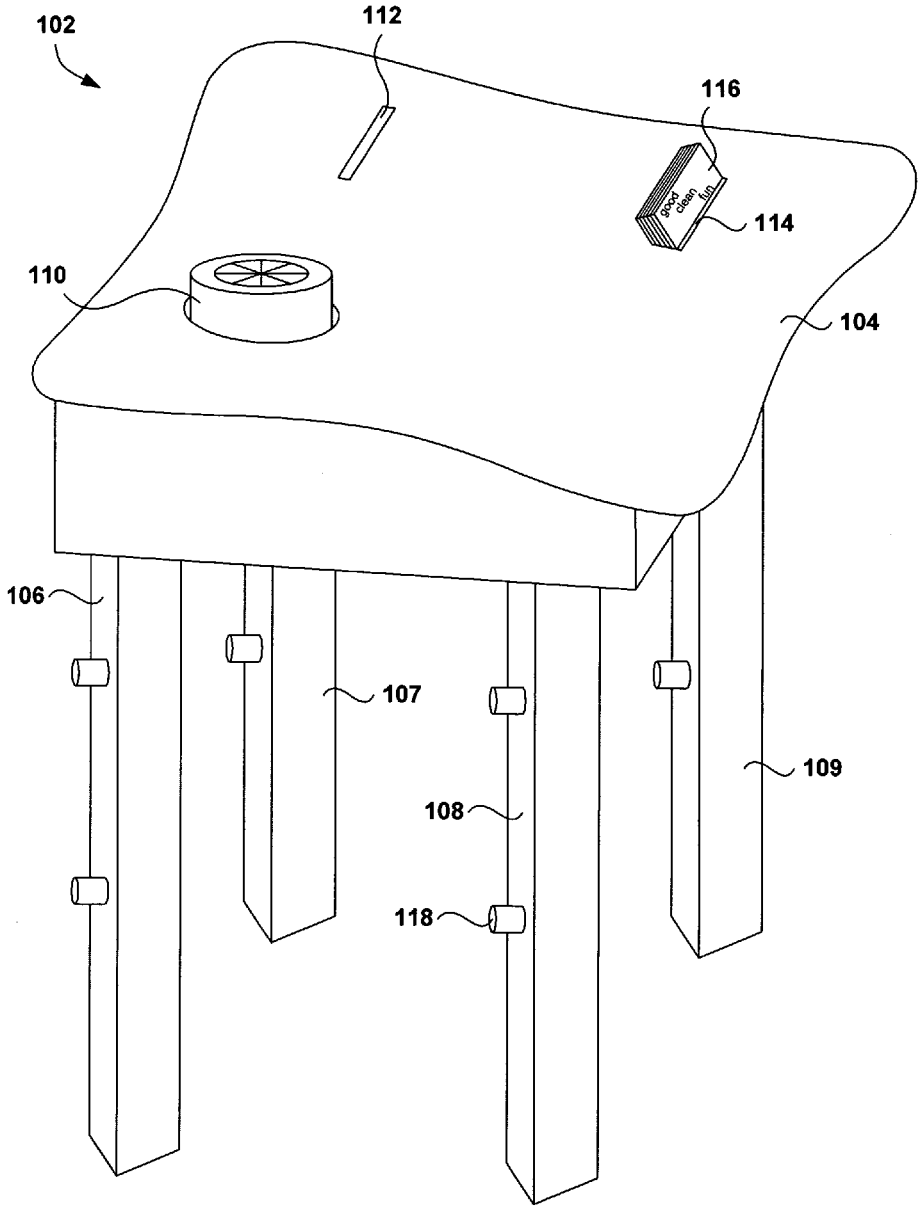
FIG. 1A shows one embodiment of a toy station.

Various embodiments of the present invention provide methods and systems for distribution and maintenance of entertainment-related objects and devices. In one embodiment, a toy station is provided to a location to serve as a receptacle for toy deployment and recollection. FIG. 1 shows one embodiment of a toy station. The toy station 102 includes a top surface 104 and four support legs 106–109. The top surface 104 includes a disinfectant-wipe dispenser 110 and a disposal aperture 112. The disposal aperture 112 lies over a collection bin below the top surface 104 for collecting discarding disinfectant-wipes. The top surface 104 further includes a recess 114 for displaying business cards 116. Each support leg 106-109 may include one or more nubs, such as nub 118, from which toys may be hung.

Figure 1B:
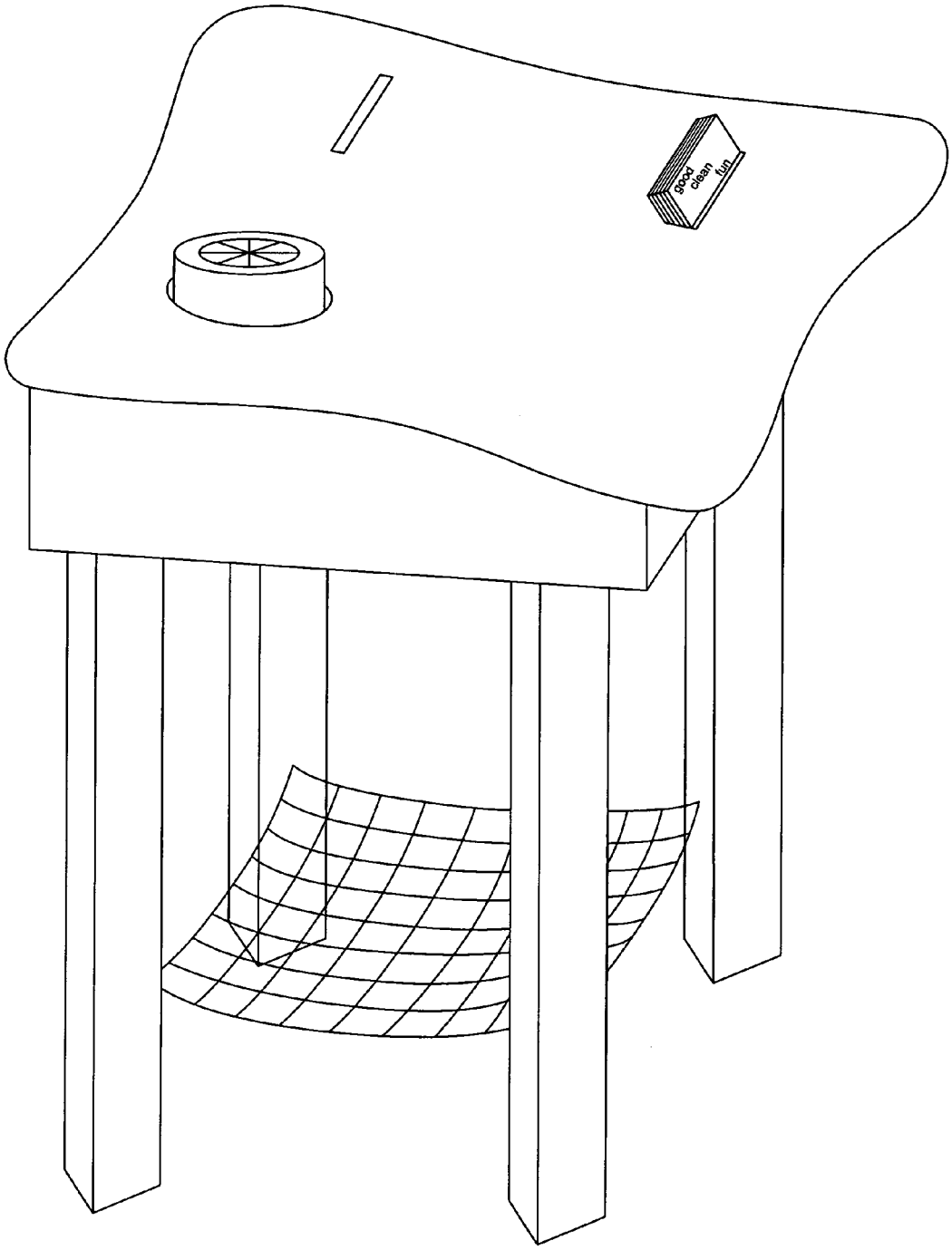
FIG. 1B shows a toy station that includes a net for storing entertainment objects.
Figure 1C:
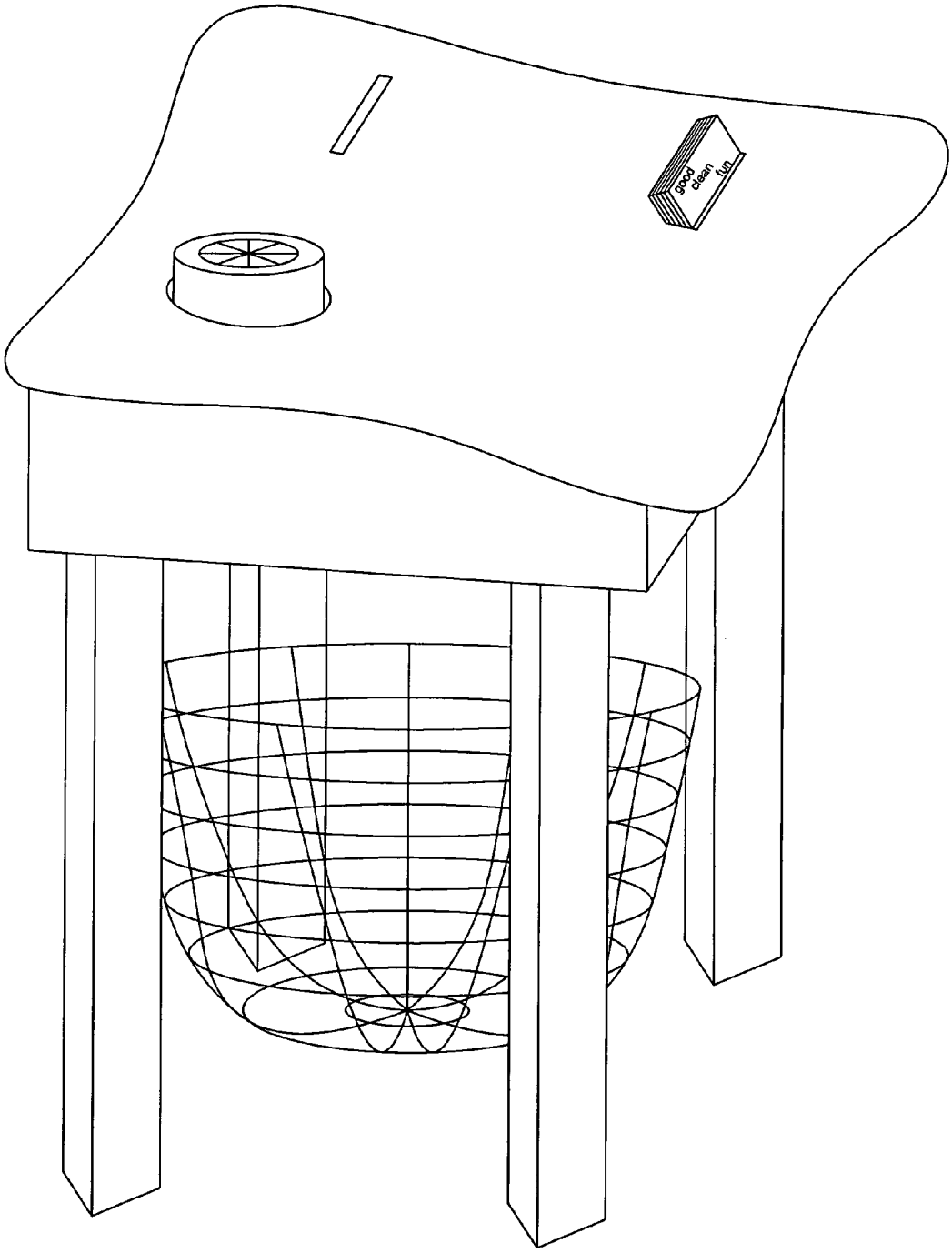
FIG. 1C shows a toy station that includes a basket for storing entertainment objects.
Figure 1D:
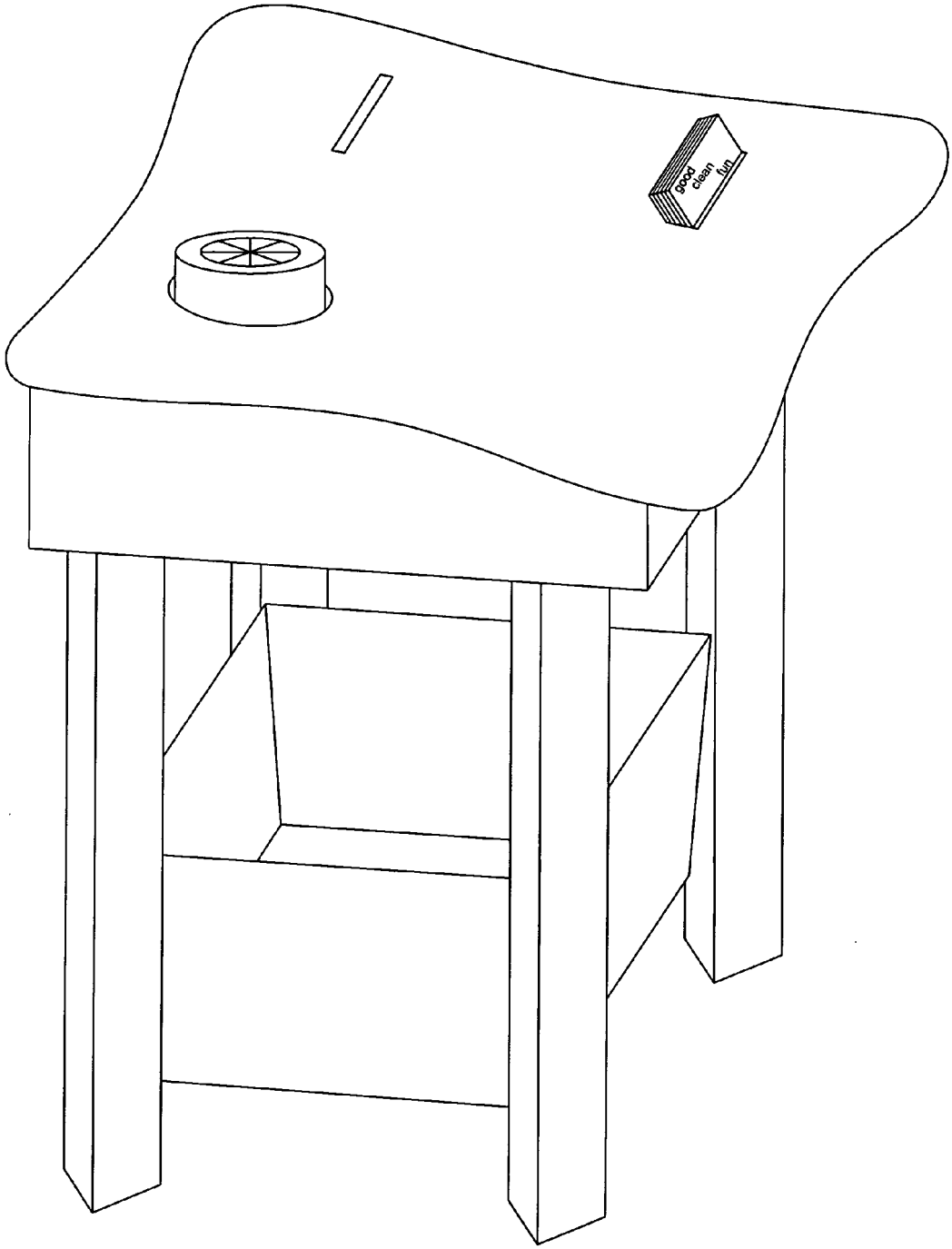
FIG. 1D shows a toy station that includes a plastic bin for storing entertainment objects.

The top surface 104 of the toy station 102 may be used as a surface on which a toy-user, or the parent or guardian of a toy-user, may clean a toy prior to use. The toy may be wiped with a disinfectant-wipe provided from the disinfectant-wipe dispenser 110. The toy-user may drop the used disinfectant-wipe into the disposal aperture 112. The disinfectant-wipe then falls into the collection bin. The collection bin should be regularly emptied by an overseer of the location of the toy station. In alternate embodiments, a net, basket, plastic bin, or other type of container may be attached to, or associated with the toy station, for storing toy-station toys. FIG. 1B shows a toy station that includes a net for storing entertainment objects. FIG. 1C shows a toy station that includes a basket for storing entertainment objects. FIG. 1D shows a toy station that includes a plastic bin for storing entertainment objects. Toys within the toy station may be constantly or automatically exposed to a disinfectant medium, such as electromagnetic radiation, or a disinfectant spray or liquid, in order to disinfect the toys while they are stored.

Figure 2:
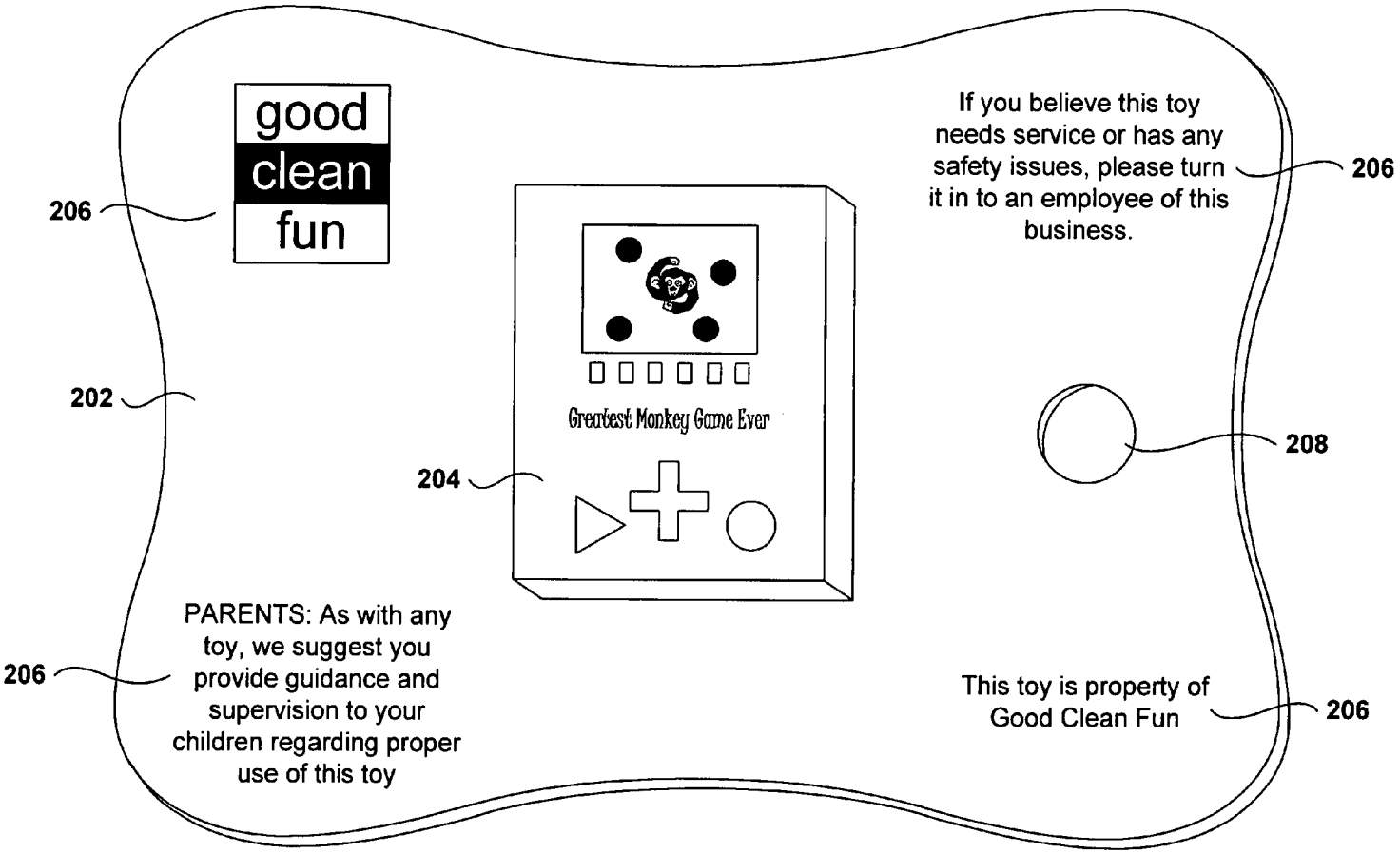
FIG. 2 shows a toy mounted to one embodiment of a substrate.

Each toy, or other entertainment device, is attached to a substrate. FIG. 2 illustrates one embodiment of a toy attached to a substrate. The substrate 202 includes an attached toy 204, assorted text and pictures 206, and a mounting aperture 208 for mounting the substrate 202 to the toy station, 102 in FIG. 1. The substrate 202 has a distinctive shape and color, and is made from a lightweight durable material such as wood, polyvinylchloride, ethylene vinyl acetate foam, or plastic. The substrate 202 shown in FIG. 2 is roughly rectangular in shape with rounded corners and concave edges. The substrate 202 is sized and shaped to fit in the lap of the toy-user and allow the toy-user to conveniently operate the attached toy 204.

At the same time, the distinctive shape, size, coloration and other markings of the substrate deter theft of the toy 204 and serve to identify the attached toy as belonging to the set of toy-station toys. Each toy is affixed to a substrate forming a member of the exclusive set of toy-station toys. Each substrate removably attaches to the toy station. Substrates corresponding to a particular toy station contain one or more similar distinctive markings, such as a particular shape, color, material or surface ornamentation. Establishing the toy-station-associated toys as belonging to an exclusive set reduces confusion of toy-station toys with personal items of users and customers. Additionally, it reduces intermixing of toys between two or more toy stations within close proximity to one another.

The toy 204 is permanently affixed to the substrate 202 by an adhesive product, such as an epoxy, or by a process requiring a special tool such as a key, a specifically-shaped instrument, or a solvent. The height and width of the substrate 202 are greater than the height and width of the portion of the toy 204 attached to the substrate 202. The open portions of the substrate 202, not obstructed by the attached toy 204, may be adorned with various pictures and text 206 providing information for the toy-user such as operational instructions, parental warnings, brandings, advertisements, as well as proprietary and identification markings such as documentation numbers recording the history of the toy 204. Commonly employed toys may include such items as games, books, electronic devices, readers, music and video players, puzzles, and novelty items. Note that toys lacking a flat side may require an alternative method of attachment such as lanyarding. Alternate embodiments of the substrate may include radio frequency identification tags, electronic memories, and input/output connections to allow information describing the toy and history of use stored and retrieved electronically.

Figure 3:
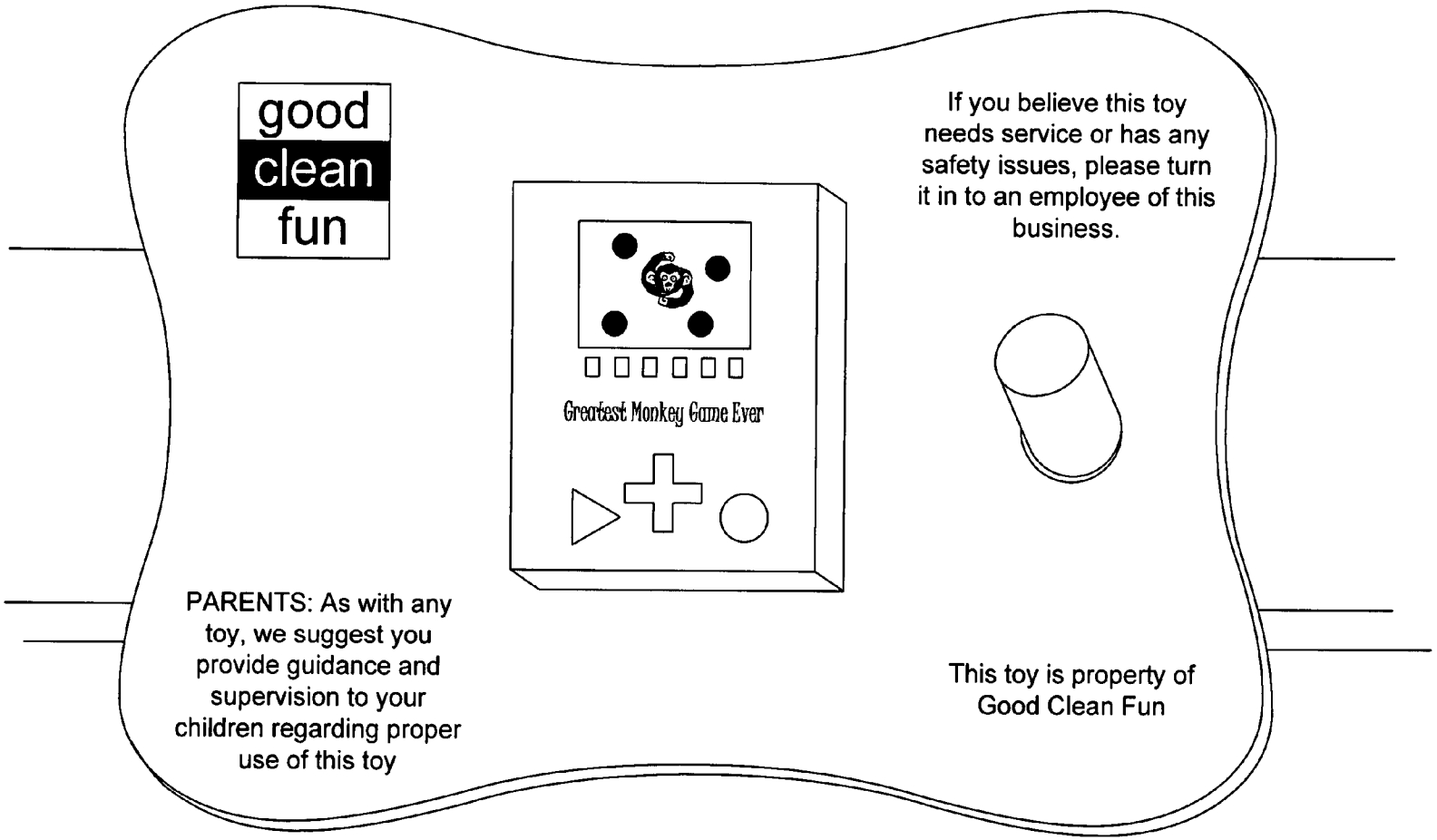
FIG. 3 shows a close-up view of one embodiment of a toy mounted to a substrate and attached to one leg of a toy station.

FIG. 3 shows a close-up view of one embodiment of a toy mounted to a substrate and attached to one leg of a toy station. The substrate attaches to the toy station by mating a nub, 118 in FIG. 1, to a mounting aperture, 208 in FIG. 2. Each nub, 118 in FIG. 1, on the toy station is sized to fit through the mounting aperture, 208 in FIG. 2, of each substrate.

Figure 4:
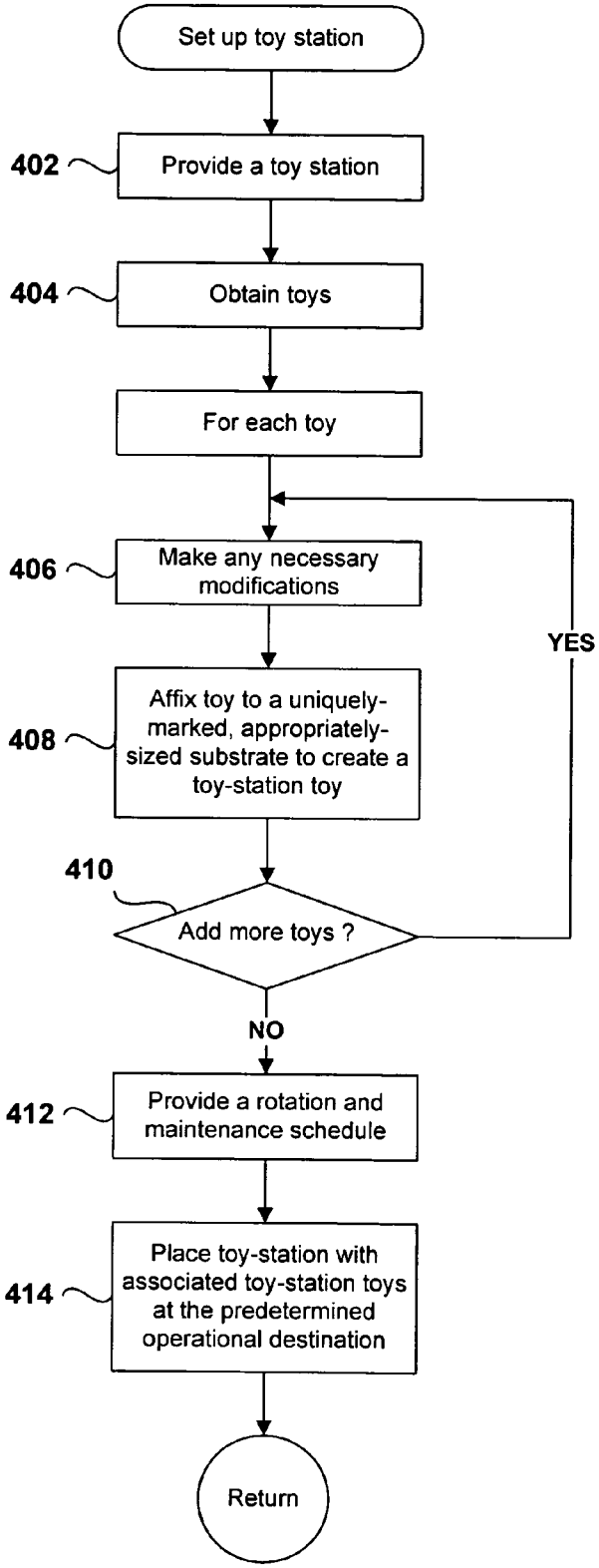
FIG. 4 is a control-flow diagram illustrating the method of setting up a toy station.

FIG. 4 is a control-flow diagram illustrating the method of setting up a toy station. In step 402 a toy station is fabricated and/or assembled. Then, in step 404 toys are acquired. In step 406 each toy is examined to determine whether any modifications to the toy are needed. For instance, the sound-making capabilities of some toys must be disabled. Some toys may require removal of projections and/or the filling of recesses to promote a flat surface for substrate attachment. Additionally, some toys may also require other dimensional modifications such as smoothing edges, removing portions of casings, and/or creating holes for substrate attachment. In step 408 each toy is affixed to a uniquely-marked, appropriately-sized substrate to create a toy-station toy. In step 410 it is determined whether additional toy-station toys are needed. If so, then control flows back to step 406. Otherwise, a maintenance schedule is created for the toy station and associated toy-station toys in step 412. Finally, in step 414 the toy station and related toy-station toys are delivered to the predetermined operational destination.

Figure 5:
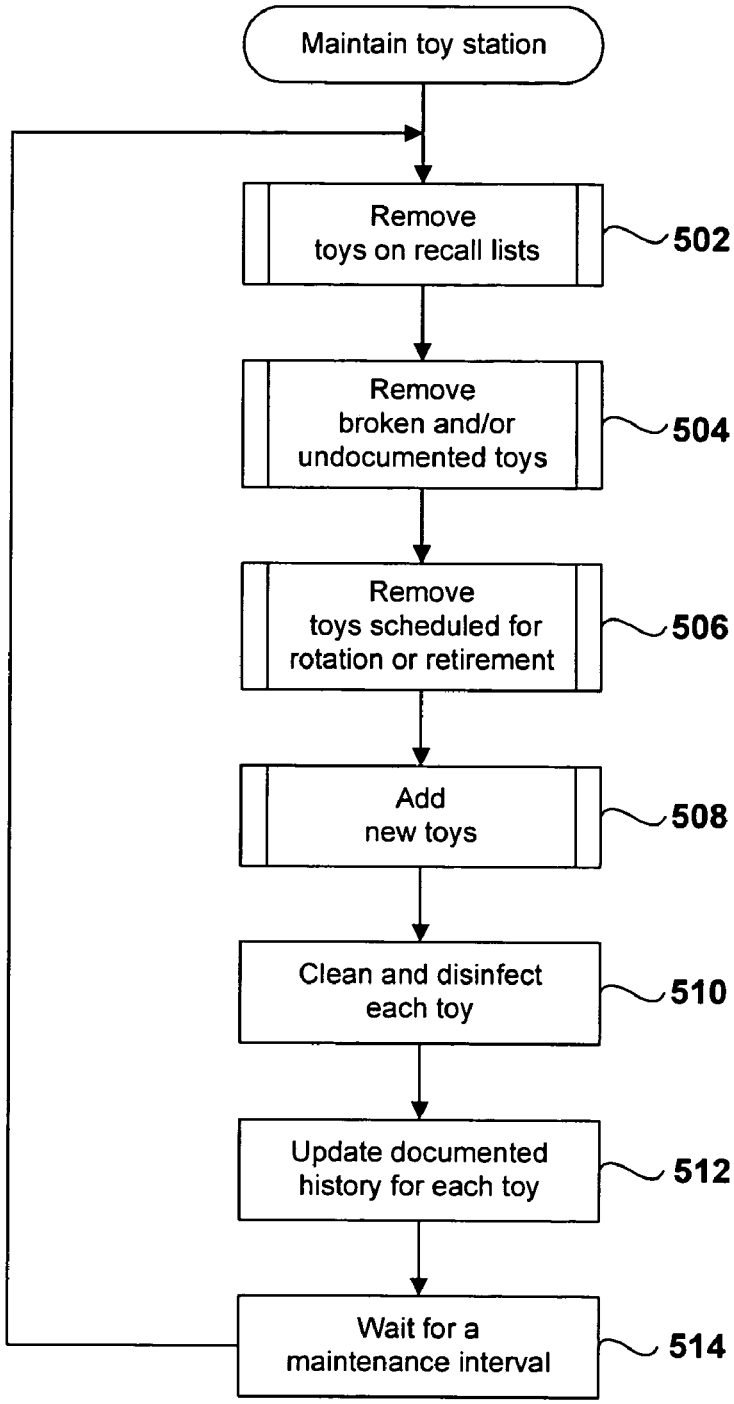
FIG. 5 is a control-flow diagram illustrating the method of maintaining a toy station.

Once the toy station and related toy-station toys are brought to the predetermined operational destination, the maintenance schedule begins. Maintenance of the toys occurs at the end of each regular maintenance interval as determined in step 412 in FIG. 4. FIG. 5 is a control-flow diagram illustrating the method of maintaining a toy station. In step 502 each toy is checked against Consumer Product Safety Commission product-recall lists, manufacturer-provided recall lists, or other known relevant lists of recalled toys. Control is then passed to a toy-removal routine.

Figure 6:
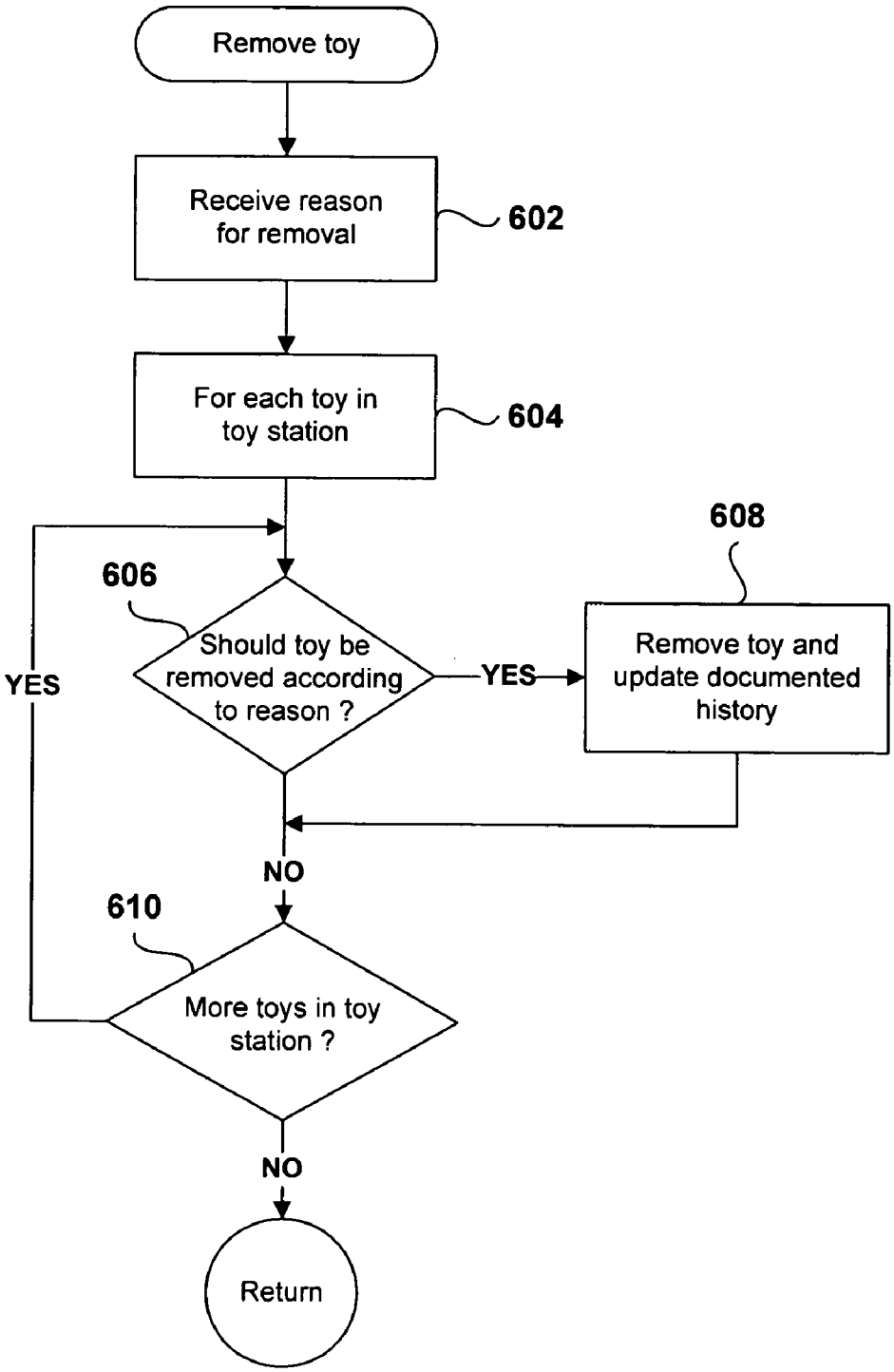
FIG. 6 is a control-flow diagram illustrating a routine for removing toys from the toy station.

FIG. 6 is a control-flow diagram illustrating a routine for removing toys from the toy station for any particular reason. In step 602 a reason is received for removing a toy. Each toy in the toy station is considered to be removed, one toy at a time, for the particular reason in step 604. In step 606 it is determined whether the first toy considered should be removed for the reason. If so, then the toy is removed and the toy's documented history is updated in step 608. Otherwise, in step 610 it is determined whether there are more toys in the toy station to be considered for removal from the toy station for the reason. If so, then control is passed back to step 606 and the cycle repeats until each toy in the toy station is considered. Otherwise, control is passed back to the maintenance control-flow diagram illustrated in FIG. 5.

For example, referring back to step 502 in FIG. 5, each toy is checked against various recall lists and control is passed to the toy removal routine in FIG. 6. If any toy is found on one or more recall lists, as determined in step 606, then that toy is removed and the toy's documented history is accordingly updated in step 608. Otherwise, control is passed back to the maintenance control-flow diagram illustrated in FIG. 5.

In step 504, each toy is visually inspected for broken, torn, bent, or worn pieces and surfaces, unsafe edges, proper documentation, and proper functioning. Control is passed back to the toy-removal routine illustrated in FIG. 6. If any toy is found to be unduly worn, broken, undocumented, malfunctioning, nonfunctioning, unsafe, or not belonging to the toy station, as determined in step 606, then that toy is removed and the toy's documented history is accordingly updated in step 608. Otherwise, control is passed back to the maintenance control-flow diagram illustrated in FIG. 5.

In step 506, each toy is checked against a list of toys scheduled for rotation or retirement. Control is passed back to the toy-removal routine illustrated in FIG. 6. If any toy is found on a list of toys scheduled for rotation or retirement, as determined in step 606, then that toy is removed and the toy's documented history is accordingly updated in step 608. Otherwise, control is passed back to the maintenance control-flow diagram illustrated in FIG. 5.

Figure 7:
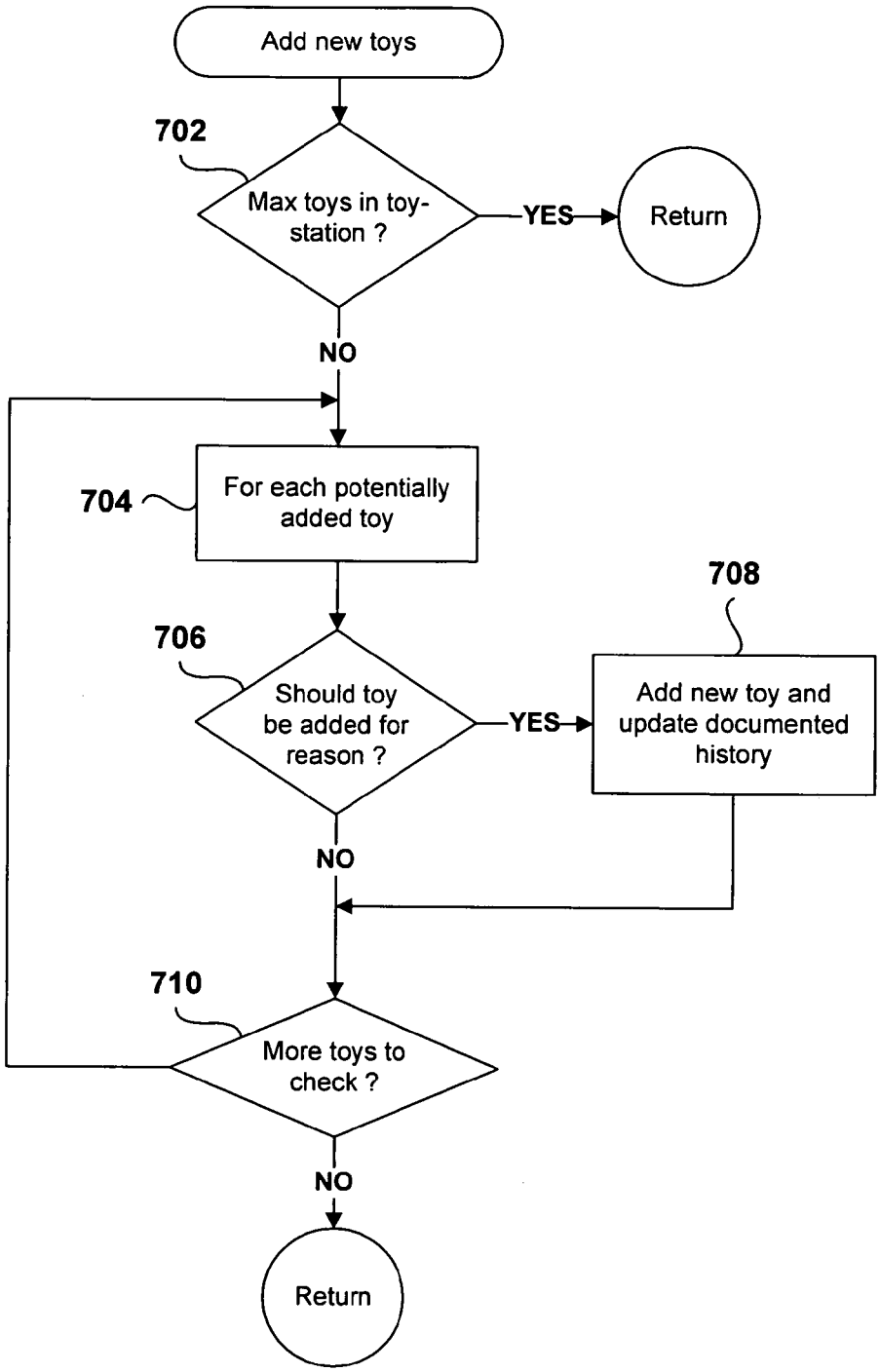
FIG. 7 is a control-flow diagram illustrating a routine for adding new toys to the toy station.

Next, in step 508, it is determined whether additional toys need to be brought to the toy station. Control is passed to an add-new-toy routine. FIG. 7 is a control-flow diagram illustrating a routine for adding new toys to the toy station. If it is determined that the toy station is already at the maximum number of toys available for that toy station, in step 702, then control is passed back to the maintenance control-flow diagram illustrated in FIG. 5. Otherwise, a potentially-available new toy is examined in step 704. If it is determined, in step 706, the available new toy should be added. Then, in step 708 the new toy is added and the toy's documented history is updated. Otherwise, in step 710, it is determined whether additional new toys need to be considered for addition. If so, then control is passed back to step 704 and the cycle continues until each potentially-available new toy is considered. Otherwise, control is passed back to the maintenance control-flow diagram illustrated in FIG. 5. In step 510, each toy is cleaned and disinfected. Next, the documented history of each toy at the toy station is updated in step 512. In step 514, control waits for a regular maintenance interval before flowing back to step 502.

Once the toy station and associated toys are on-site at the predetermined operational location, toy-users may approach the toy station, pick out a toy, and remove the toy from the toy station. The toy-user may use the provided disinfectant-wipes, contained within the disinfectant-wipe dispenser within the toy station, to wipe off each toy prior to use. The toy-user may then use the provided toy in proximity to the toy station and return the toy to the toy station after use.

Although the present invention has been described in terms of a particular embodiment, it is not intended that the invention be limited to this embodiment. Modifications within the spirit of the invention will be apparent to those skilled in the art. For example, many configurations and methods of attaching and mounting components to various assemblies different from those shown in the figures and described in the above text may be employed. Different methods of attaching toys to a substrate, other than mentioned above, may be employed such as using two-sided tape. Moreover, different methods of attachment of a substrate to a toy station may be employed such as using hooks, hook and loop fasteners, or providing a storage bin, net, basket, or other container suitable for collecting toys at the toy station. Alternate methods of identifying and documenting toy history may be employed such as implementing radiofrequency identification tags affixed to each substrate. Different arrangement of the toy stations may be employed such as designing the toy station as a rack or shelving unit or self-standing tripod either with or without a top surface. The toy station may be free-standing, or it may hang from a ceiling or horizontal support member, or it may be mounted to a wall vertical support member. Alternate methods of cleaning and disinfecting toys by toy-users may be utilized such as using electromagnetic radiation or various types of liquids or sprays. Additionally, alternate embodiments of the toy station may be sized to accommodate different numbers of toys mounted to substrates depending on the individual needs of the predetermined operational location of the toy-station.

The foregoing detailed description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description; they are not intended to be exhaustive or to limit the invention to the precise forms disclosed. Obviously many modifications and variation are possible in view of the above teachings. The embodiments were chosen and described in order to best explain the principles of the invention and its practical applications and to thereby enable others skilled in the art to best utilize the invention and various embodiments with various modifications as are suited to the particular use contemplated.

The invention claimed is:

1. An entertainment-object station comprising:

an entertainment-object holder;

a plurality of entertainment-object-station substrates, visually associable with the entertainment-object station, removably mounted to the entertainment-object holder;

entertainment objects permanently affixed to the entertainment-object-station substrates;

a disinfectant-wipe dispenser for dispensing disinfectant-wipes for cleaning entertainment objects; and a top surface and support legs, one or more of the support legs including one or more nubs, each nub sized to pass through a mounting aperture on each entertainment-object-station substrate.

2. A method for entertainment-object management, the method comprising:

providing an entertainment-object station that includes an entertainment-object holder, a plurality of entertainment-object-station substrates, the entertainment-object-station substrates visually associable with the entertainment-object station, a number of entertainment objects, a disinfectant-wipe dispenser for dispensing disinfectant-wipes for cleaning entertainment objects, and a top surface and support legs, one or more of the support legs including one or more nubs, each nub sized to pass through a mounting aperture on each entertainment-object-station substrate;

attaching each entertainment object to an entertainment-object-station substrate;

removably mounting entertainment-object-station substrates to the entertainment-object holder;

placing the entertainment-object holder with removably mounted entertainment-object-station substrates in a location; and maintaining the entertainment-object holder with removably mounted entertainment-object-station substrates by periodically replacing one or more stale entertainment objects, periodically replacing recalled entertainment objects, periodically replacing broken entertainment objects, and periodically adding new entertainment objects.

* * * * *